US007789272B2

(12) United States Patent
Alticosalian

(10) Patent No.: US 7,789,272 B2
(45) Date of Patent: Sep. 7, 2010

(54) DEVICE FOR STORING AND DISPENSING LIQUID

(76) Inventor: Gerald Hagop Alticosalian, 27 Beaufort Road, Ealing, London W5 3EB (GB)

( * ) Notice: Subject to any disclaimer, the term of this patent is extended or adjusted under 35 U.S.C. 154(b) by 227 days.

(21) Appl. No.: 11/853,253

(22) Filed: Sep. 11, 2007

(65) Prior Publication Data

US 2008/0000930 A1 Jan. 3, 2008

Related U.S. Application Data

(63) Continuation of application No. PCT/GB2006/000850, filed on Mar. 10, 2006.

(51) Int. Cl.
*B67D 7/06* (2010.01)

(52) U.S. Cl. ..... 222/144.5; 222/144; 222/501

(58) Field of Classification Search ..... 222/518, 222/144, 144.5, 501, 94, 402.1, 402.2, 402.24, 222/402.25, 402.12, 476; 401/213; 221/123, 221/42, 34; 251/354
See application file for complete search history.

(56) References Cited

U.S. PATENT DOCUMENTS

| | | | | | |
|---|---|---|---|---|---|
| 1,989,738 | A | | 2/1935 | Carson | 221/16 |
| 2,694,512 | A | * | 11/1954 | Morris | 222/501 |
| 2,921,723 | A | * | 1/1960 | Morris | 222/501 |
| 2,954,393 | A | * | 9/1960 | Haimsohn et al. | 558/19 |
| 3,475,105 | A | * | 10/1969 | Gerson | 401/260 |
| 3,596,802 | A | * | 8/1971 | Feldman | 222/135 |
| 3,992,003 | A | * | 11/1976 | Visceglia et al. | 222/94 |
| 4,006,841 | A | | 2/1977 | Alticosalian | 222/42 |
| 4,217,994 | A | | 8/1980 | Koenig et al. | 222/212 |
| 4,413,755 | A | * | 11/1983 | Brunet | 222/402.2 |
| 4,461,408 | A | * | 7/1984 | Shepard | 222/501 |
| 4,541,552 | A | * | 9/1985 | Scheithauer | 222/501 |
| 4,549,674 | A | * | 10/1985 | Alticosalian | 222/48 |
| 6,736,288 | B1 | * | 5/2004 | Green | 222/94 |
| 7,328,670 | B2 | * | 2/2008 | Puentes-Barr | 118/13 |

FOREIGN PATENT DOCUMENTS

| | | |
|---|---|---|
| DE | 2129 597 | 12/1972 |
| FR | 1016884 | * 11/1952 |
| FR | 1 043 433 | 11/1953 |
| FR | 2 516 371 | 5/1983 |
| FR | 2 861 707 | 5/2005 |

OTHER PUBLICATIONS

International Search Report, May 24, 2006, 3 pages.

* cited by examiner

*Primary Examiner*—Kevin P Shaver
*Assistant Examiner*—Robert K Nichols, II
(74) *Attorney, Agent, or Firm*—St. Onge Steward Johnston & Reens LLC

(57) ABSTRACT

A disc-shaped device for storing and dispensing perfume has a plurality of compartments for storing different perfumes. Each compartment has an aperture through an outer circumferential wall of the device through which the perfume is released from the compartment. Each aperture contains a stem extending through the aperture and a larger diameter stem flange portion located inside each compartment which seals against the inner side of the outer circumferential wall. The stem is biased radially outwardly by resilient bands so that the stem flange is held sealed against the inner side of the outer circumferential wall. Pushing on the stem against the bias of the resilient bands opens the aperture so that perfume is released from the compartment.

17 Claims, 8 Drawing Sheets

DEVICE FOR STORING AND DISPENSING LIQUID

CROSS-REFERENCE TO RELATED APPLICATIONS

The present application is a continuation of pending International patent application PCT/GB2006/000850, filed Mar. 10, 2006, which designates the United States and claims priority from Great Britain patent application no. 0505082.8, filed Mar. 11, 2005, the content of which is incorporated herein by reference.

BACKGROUND OF THE INVENTION

The present invention relates to a device for storing and dispensing liquid, such as perfume. Samples of perfume may be distributed with magazines so that the purchaser of the magazine may be tempted to buy the perfume after trying the sample. One example of a known perfume sample is a Scent-Seal® which comprises a pouch in which the perfume is sealed between two layers of foil laminate and is released when the pouch is opened. Alternatively, another known perfume sample is a ScentStrip® in which the perfume is microencapsulated between two layers of paper and is released by snapping apart the two layers. A problem with these perfume samples is that the perfume can only be sampled once at the time it is initially released and it cannot be tried again later. Also, a user may have some difficulty in releasing perfume from the perfume sample when, say, tearing open the pouch.

SUMMARY OF THE INVENTION

An object of the present invention is to provide a device for storing and dispensing liquid, such as perfume, which alleviates at least one of the above-mentioned problems.

According to one aspect of the present invention there is provided a device for storing and dispensing liquid, such as perfume, comprising:— at least one compartment for storing the liquid, the or each compartment having an aperture through which liquid is released from the compartment; sealing means for closing the or each aperture; resilient means mounted within the or each compartment and being arranged to bias the sealing means to close the aperture; and actuating means connected within the or each compartment to said resilient means and extending out of said compartment through said aperture, said actuating means being arranged upon actuation thereof to open said aperture against the bias of said resilient means and thereby enable liquid to be released from said compartment.

The resilient means enables the compartment to be resealed after liquid has been released by the actuating means, thereby enabling any liquid still in the compartment to be retained and released subsequently.

The sealing means may comprise a seal formed with the compartment wall in which the aperture is formed. The actuating means may comprise an elongate member extending through the aperture and on which the sealing means is mounted, such that actuation of the elongate member opens the aperture by moving the seal away from the compartment wall.

The sealing means may be at least provided by an interference fit between the actuating means and the aperture through which the actuating means extends. The actuating means may comprise an elongate member having at least two different cross-sectional areas along its length, a first cross-sectional area providing the interference fit to seal the aperture and a second cross-sectional area being smaller than the aperture, such that movement of the elongate member within the aperture releases the interference fit and opens the aperture.

The device may comprise a moulded unitary piece of plastics material forming at least one wall of the or each compartment, the sealing means, the resilient means and the actuating means. The device desirably includes a plurality of compartments, each compartment having said aperture, sealing means, resilient means and actuating means and being intended to contain a different liquid. The compartments may be arranged in an annular formation with each of the apertures being formed in an outer peripheral wall of the device. There may be a movable shield provided over the or each aperture so as to inhibit accidental actuation of the actuating means.

According to another aspect of the present invention there is provided a method of making a device for storing and dispensing liquid, such as perfume, said device comprising at least one compartment for storing the liquid, the or each compartment having an aperture through which liquid is released from the compartment; sealing means for closing the or each aperture; resilient means mounted within the or each compartment and being arranged to bias the sealing means to close the aperture; and actuating means connected within the or each compartment to said resilient means and extending out of said compartment through said aperture, said actuating means being arranged upon actuation thereof to open said aperture against the bias of said resilient means and thereby enable liquid to be released from said compartment, the method comprising the step of moulding a unitary piece of plastics material to form at least one wall of the or each compartment, the resilient means, the sealing means and the actuating means.

By moulding a unitary piece of plastics material comprising at least one wall of the or each compartment, the resilient means, the sealing means and the actuating means, the device is inexpensive to make. The device is cheap enough to manufacture to enable it to be given away with a magazine, and is preferably arranged to have dimensions to enable it to be inserted into the magazine or be attached to the front cover of the magazine. The device is designed to last for a relatively short period and be disposed of when finished with.

In moulding the device, the resilient means is formed in an uncompressed state. The step of moulding the unitary piece of plastics material may include providing integrally interconnected said actuating means and said resilient means by an integral hinge with the actuating means being moulded at an angle relative to the resilient means, and the actuating means is subsequently pivoted in line with the resilient means so that the actuating means can extend through the aperture.

By moulding the actuating means at an angle relative to the pivot means, the actuating means can be made without any seams along its length as it is able to be cast in a surrounding mould and not between two mould faces. Thus, where the sealing means is provided by an interference fit between the actuating means and the aperture through which the actuating means extends, by not having any seams to obstruct the interference fit, the interference fit is improved. The method may comprise the steps of breaking the resilient means from the wall or walls of the compartment to which it is moulded, and moving the resilient means and actuating means integral therewith towards the aperture so that the actuating means extends through the aperture. The step of moving the resilient means and actuating means integral therewith may include compressing the resilient means so that the resilient means biases the sealing means to close the aperture. The or each compartment is preferably formed with retaining means for retaining the resilient means when broken from the wall or walls.

The resilient means may be compressed to allow the actuating means to be pivoted in line with the resilient means so that the actuating means can extend through the aperture. Where a spacing between the end of the resilient means nearest to the sealing means and the part of the sealing means for forming the seal with the compartment wall in which said aperture is formed is greater than a spacing between the end of the resilient means, when unbiased, nearest to the sealing means and the compartment wall, this enables the resilient means to bias the sealing means to close the aperture.

The resilient means may be moulded with at least one of the side walls of said compartment. Additionally, further steps may comprise attaching top and bottom walls to the device to seal the at least one compartment with liquid contained therein.

BRIEF DESCRIPTION OF THE DRAWINGS

Embodiments of the present invention will now be described, by way of example only, with reference to the accompanying drawings, in which:—

DETAILED DESCRIPTION OF THE INVENTION

Figure 1:
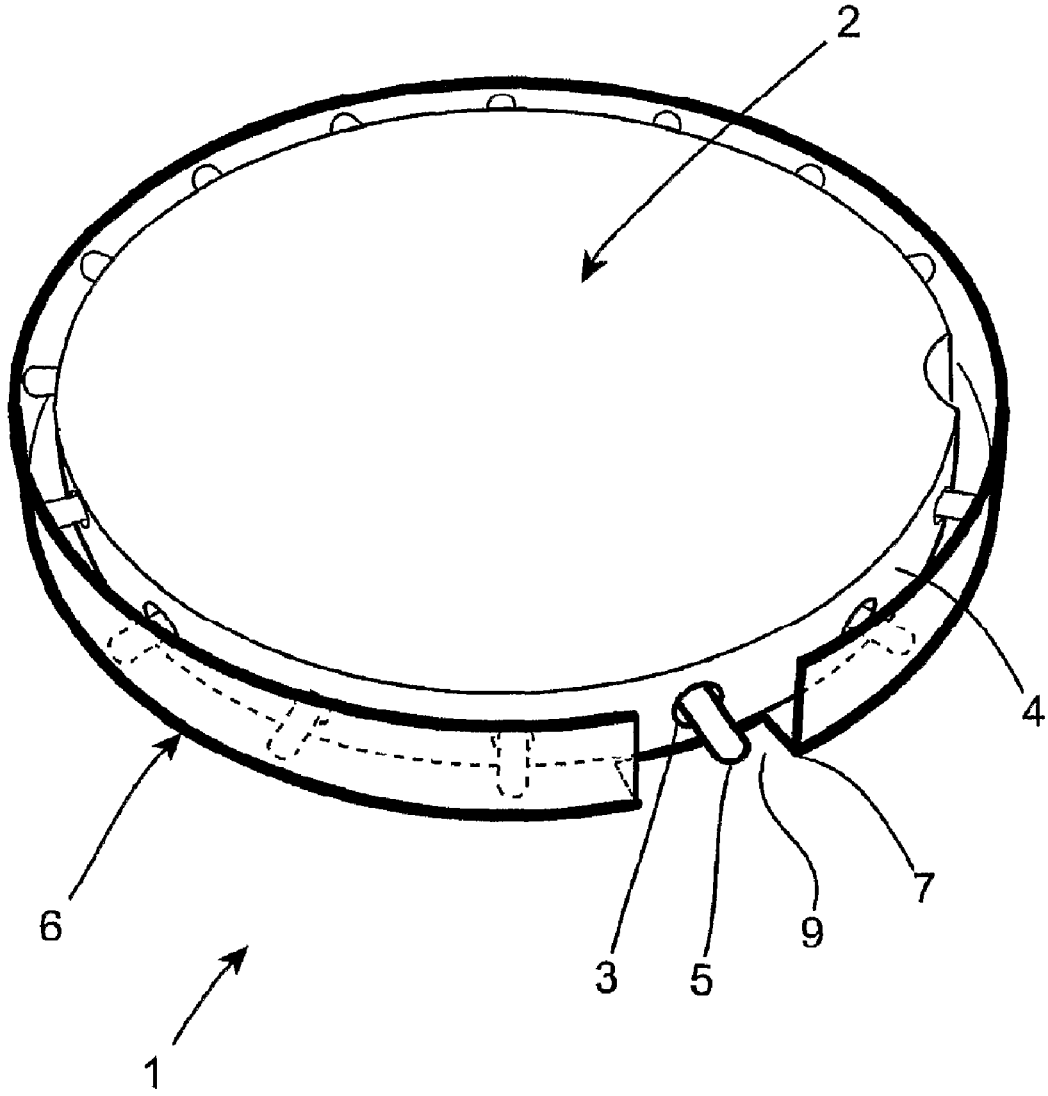
FIG. 1 is a schematic isometric view of a device in accordance with one embodiment of the invention.

Referring to FIG. 1 of the accompanying drawings, a device 1 for storing and dispensing a plurality of different perfumes, scents, fragrances or olfactory aromas, comprises a disc-shaped perfume holder 2 with apertures 3 spaced along the peripheral annular wall 4 of the holder 2 and an actuating elongate member or stem 5 protruding through each aperture 3. The discshaped holder 2 with its stems 5 fits within a shield 6 which has a circular base 7 and a peripheral annular wall 8. The annular shield wall 8 has a gap 9 through which a single stem 5 of the holder 2 can be accessed and the gap 9 extends as an indentation or recess into the shield base 7.

Figure 2:
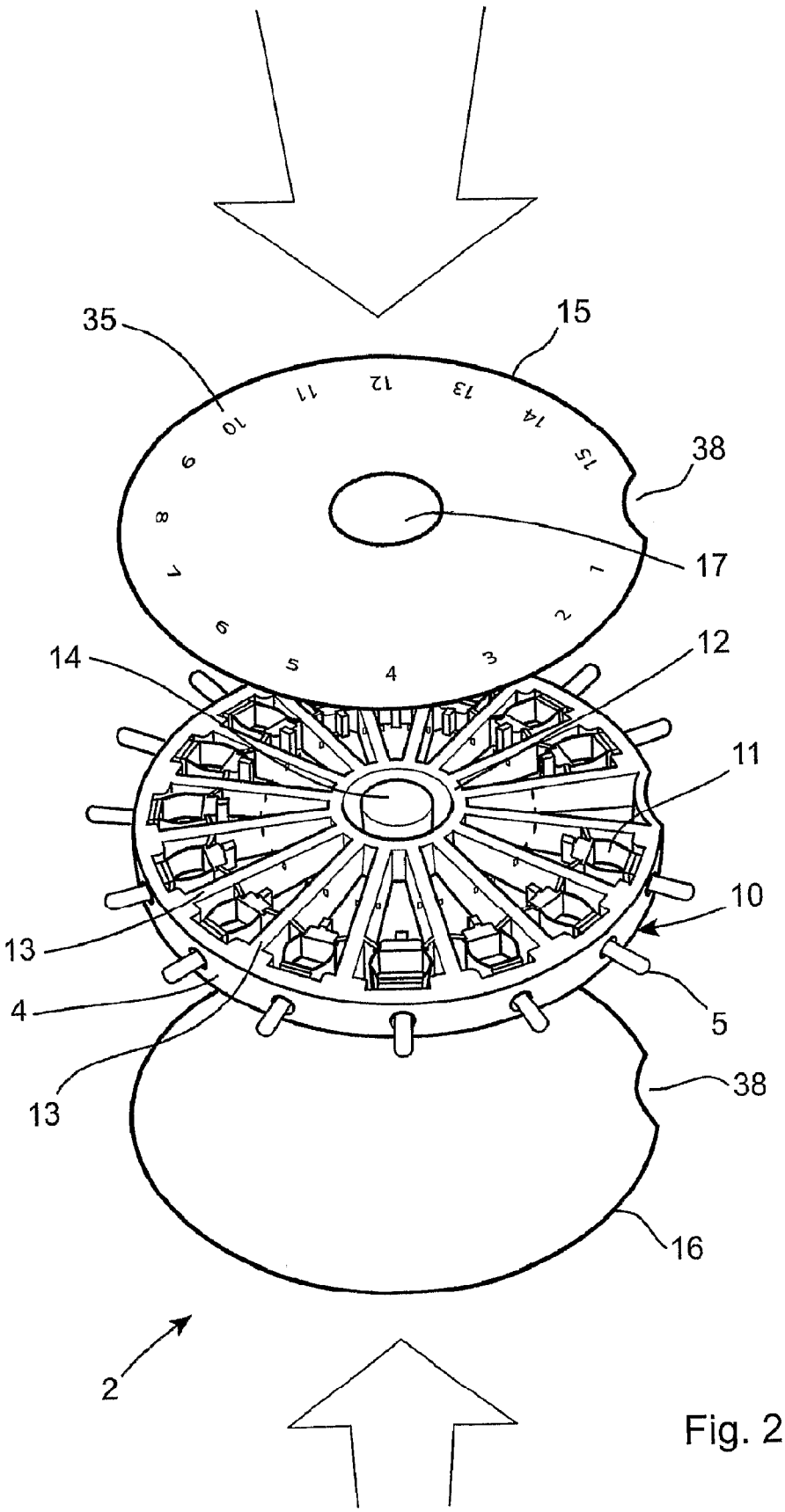
FIG. 2 is an exploded isometric view of a disc-shaped perfume holder forming part of the device.

Referring to FIG. 2, the disc-shaped perfume holder 2 has a wheel-shaped member 10 having a plurality of compartments 11, 11' arranged in an annular formation. The wheel-shaped member 10 has an outer peripheral wall which is the annular peripheral wall 4 of the holder 2 and an inner annular peripheral wall 12 with side walls 13 extending radially between the two peripheral walls 4, 12 to define the sides of the compartments 11, 11'. The inner peripheral wall 12 defines the edge of a base from which a, preferably cylindrical, hub 14 protrudes, the hub 14 being centrally positioned within the inner peripheral wall 12. First and second circular walls 15, 16 or covers cover the top and bottom of the wheel-shaped member 10 and the first circular cover 15 has a central hole 17 whose edge is coincident with the inside face of the inner peripheral wall 12.

Figure 3:
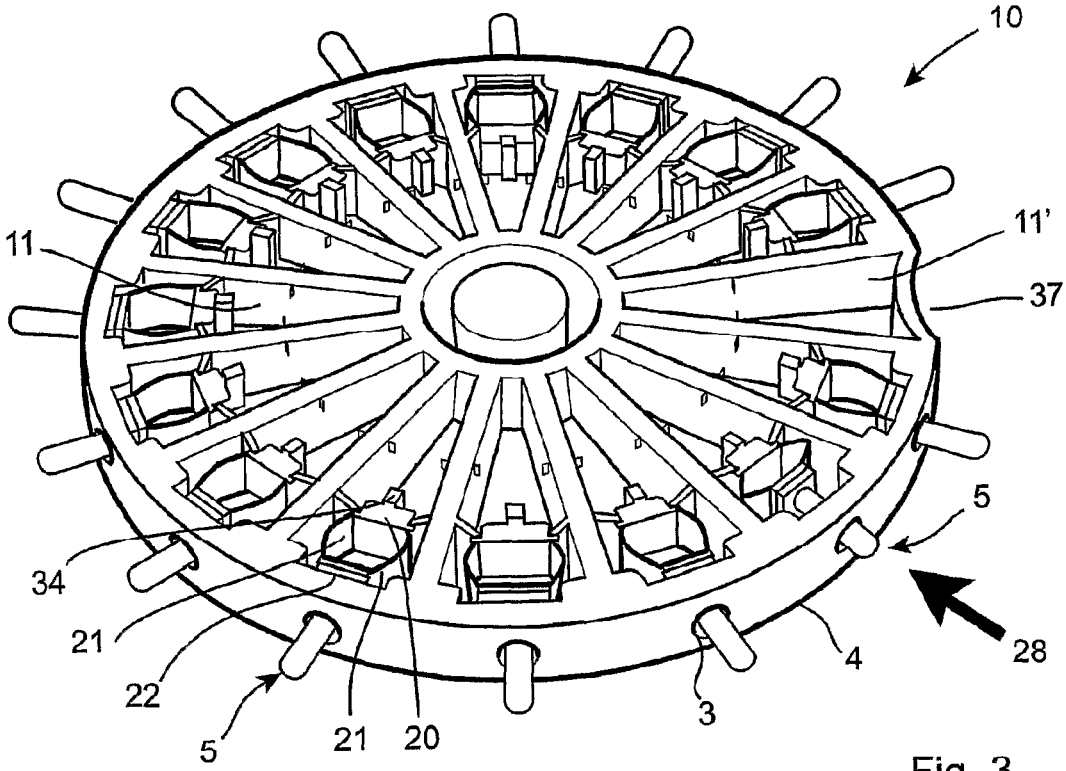
FIG. 3 is an isometric view of a wheel-shaped member of the holder.
Figure 4:
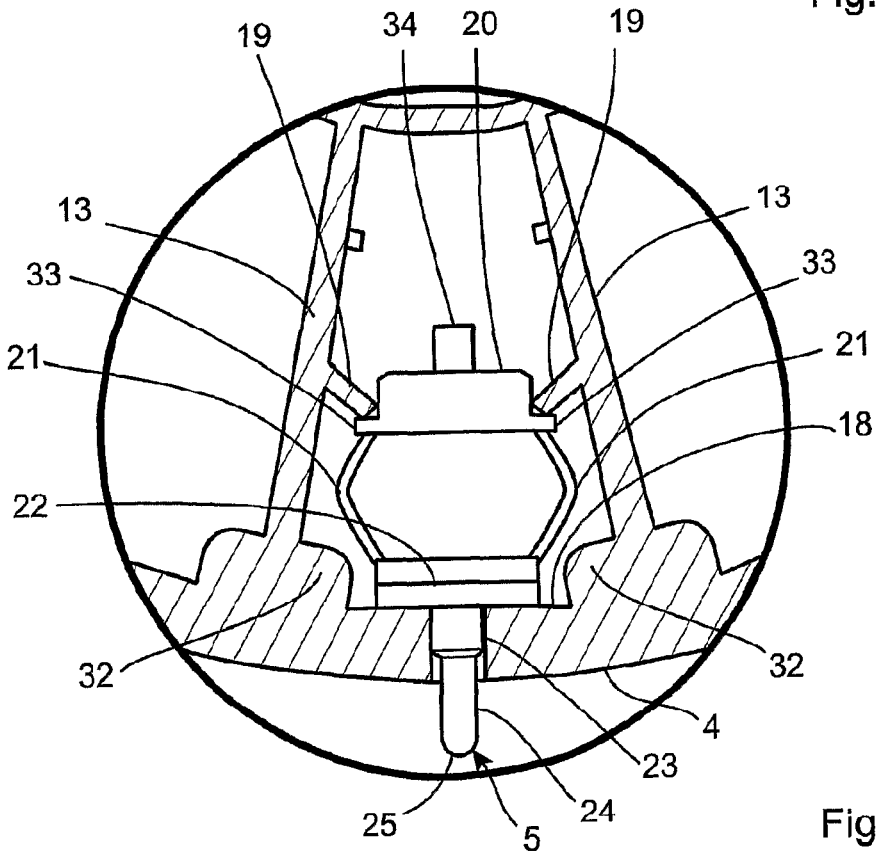
FIG. 4 is a plan section of a compartment of the wheel-shaped member when the compartment is in a sealed state.

Referring to FIGS. 3 and 4, the outer peripheral wall 4 has an inside face within each compartment 11. The inside surface forms a planar face 18 extending from infills 32 with rounded corners in the corners between the outer peripheral wall 4 and side walls 13 for all but one of the compartments of the wheel-shaped member 10 and these compartments 11 each have a pair of stop members 19. Each stop member 19 extends from an opposite side wall 13 of the compartment 11 and is inclined towards the outer peripheral wall 4. Each stop member 19 is preferably of the same height as the side wall 13. Each of the compartments 11 with stop members 19 also has one of the apertures 3 in the outer peripheral wall 4. A base portion 20 has a pair of flanges 33 abutting against the stop members 19. The base portion 20 is shorter in height than the side walls 13 of the compartment 11 and a column portion 34 extends from the middle of the side of the base portion 20 facing the inner peripheral wall 12 and the column portion 34 is the height of the side walls 13. A pair of resilient bands 21 bending away from each other extends from the base portion 20 to a base portion 22 for the elongate stem 5. The stem base portion 22 abuts the planar face 18 to form a seal with the face 18 of the outer peripheral wall 4 of the compartment 11 and the stem 5 extends through the aperture 3 from the stem base portion 22. The elongate stem 5 is stepped having a portion 23 with a larger diameter or cross-sectional area adjacent the stem base portion 22 tapering to a portion 24 with a smaller diameter or cross-sectional area and the distal end 25 of the stem 5 is rounded. Each aperture 3 forms an interference fit seal with the larger diameter stem portion 23.

Figure 5:
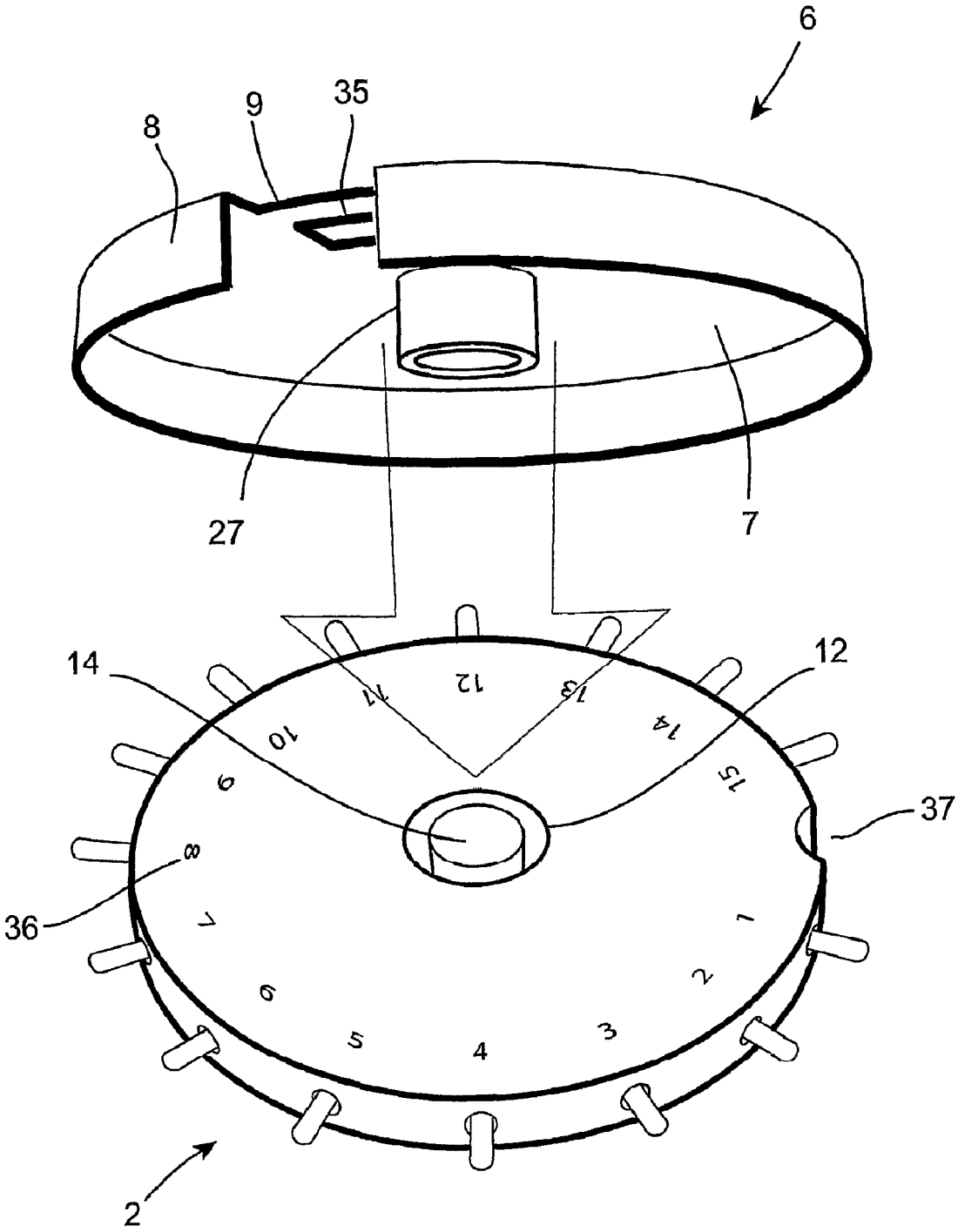
FIG. 5 is an isometric view of a shield being attached to the discshaped perfume holder.

Referring to FIG. 5, the shield 6 has a window 35 in its base 7 adjacent the gap 9 and has a, preferably cylindrical, hub 27 extending from the shield base 7. The hub 27 fits between the hub 14 and the inner peripheral wall 12 of the wheel-shaped member of the disc-shaped perfume holder 2 so as to form the device 1 shown in FIG. 1 and to enable the holder 2 and shield 6 to rotate relative to each other.

In a preferred embodiment, the device 1 has a diameter of approximately 80 millimeters and a thickness of approximately 6 millimeters.

Figure 6:
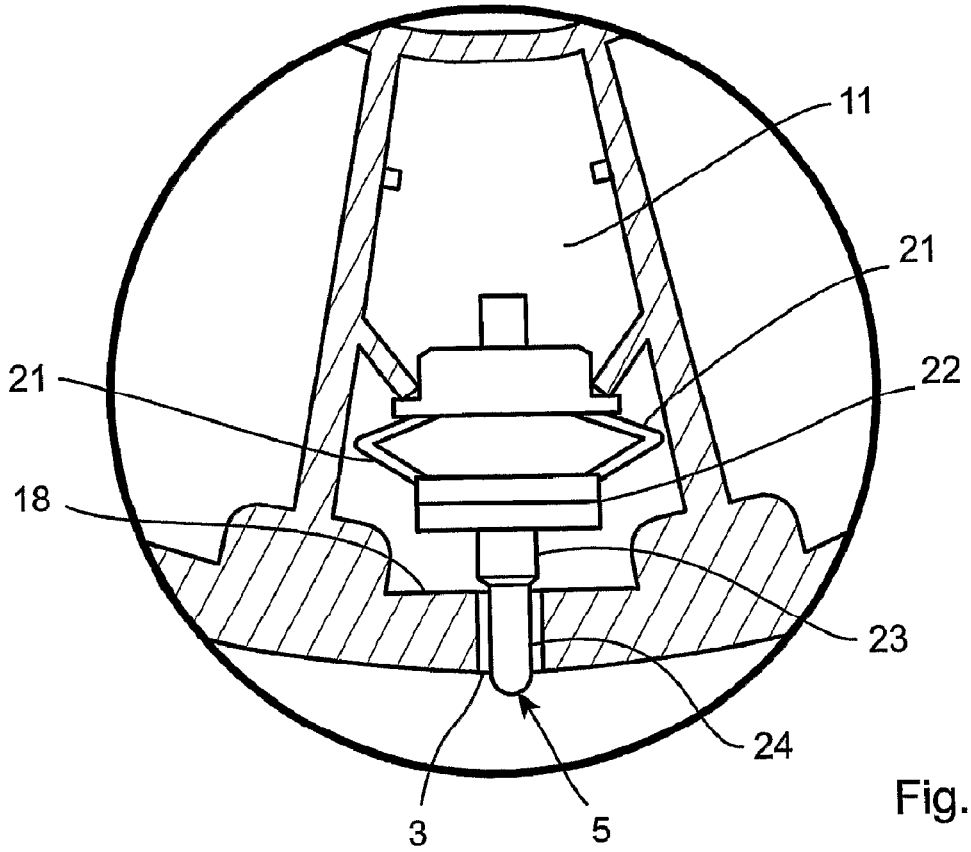
FIG. 6 shows the compartment of FIG. 4 in an unsealed state.
Figure 13:
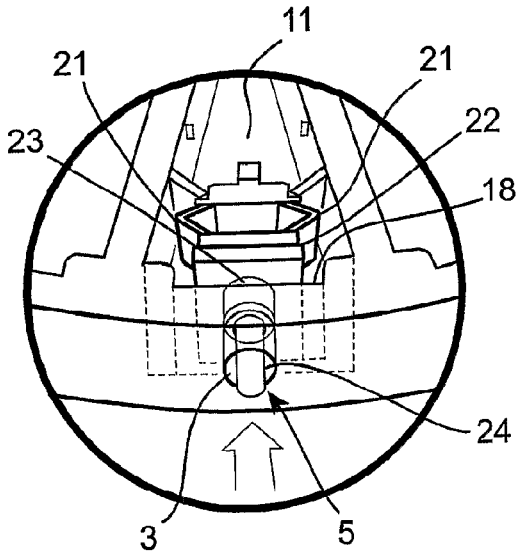
FIG. 13 is an isometric view of FIG. 6.

In use, each compartment 11 of the disc-shaped perfume holder 2 having an aperture 3 in its outer peripheral wall 4 can contain a different perfume. The first cover 15 of the holder 2 can identify each compartment 11 containing a perfume by the part of the cover over each such compartment 11 being marked by a different number 36 or by other identification means such as a different colour. To release a perfume stored in a compartment 11, the user rotates the disc-shaped perfume holder 2 about the shield 6 until the elongate stem 5 for the compartment 11 marked by the chosen identification mark 36 appears in the shield window 35 (see FIG. 8). The user actuates release of perfume by pushing the actuating elongate stem (indicated by arrow 28 in FIG. 3) into the compartment 11 causing the resilient bands 21 to be compressed against their bias. This causes the stem base portion 22 to move away from the planar face 18 so as to break the seal and the larger diameter stem portion 23 to move into the compartment 11 so that the smaller diameter stem portion 24 is within the aperture 3, thereby breaking the interference fit seal (see FIGS. 6 and 13). This opens the aperture 3 and releases perfume from the compartment 11. As the base portion 20 is shorter than the side walls 13 of the compartment 11, perfume from either side of the base portion 20 can be released. When the user releases the stem 5, the bias of the resilient bands 21 causes the stem base portion 22 to reform the seal with the planar face 18 and the larger diameter stem portion 23 to reform the interference fit seal with the aperture 3.

A website address may be printed on the centre of the second cover 16 and the device 1 is marked by a colour or other identification means such as a number. The user accesses the website on a computer and identifies the device 1 she has by entering the device identification means. A list of perfumes contained in the compartments 11 of that device 1 are then displayed along with the compartment identification means 36 identifying which compartment contains which perfume. From this, the user knows which compartment 11 in the device contains the perfume that she wants to try.

Figure 7:
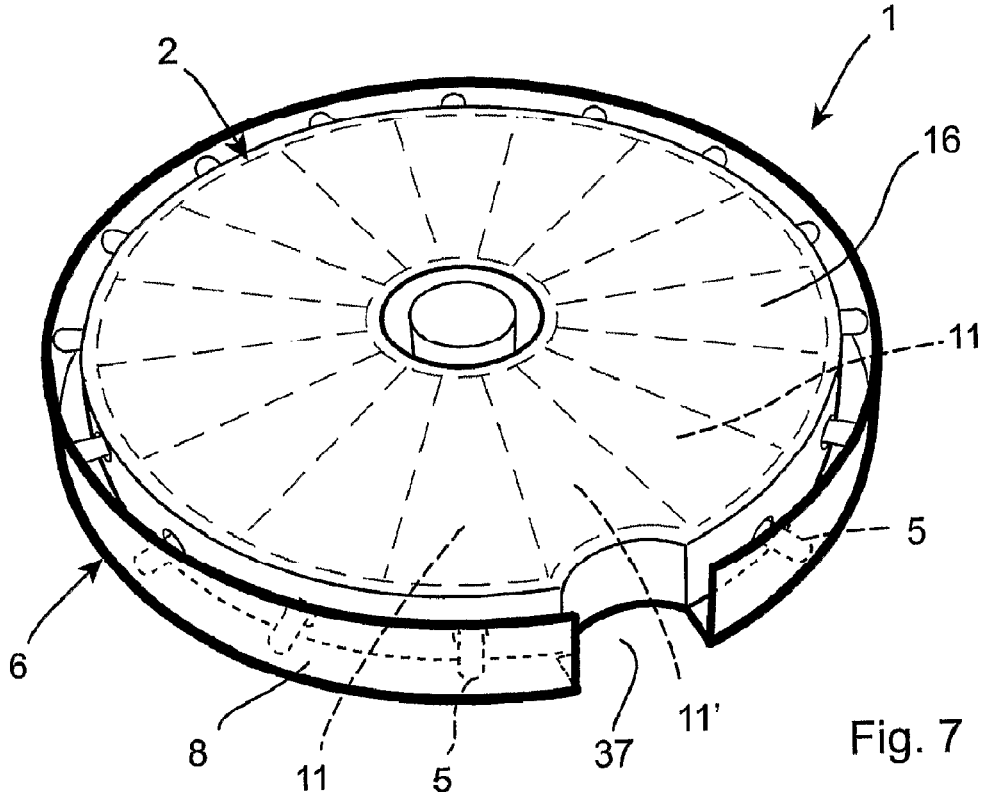
FIG. 7 is an isometric view of the device when inhibited from actuation.
Figure 9:
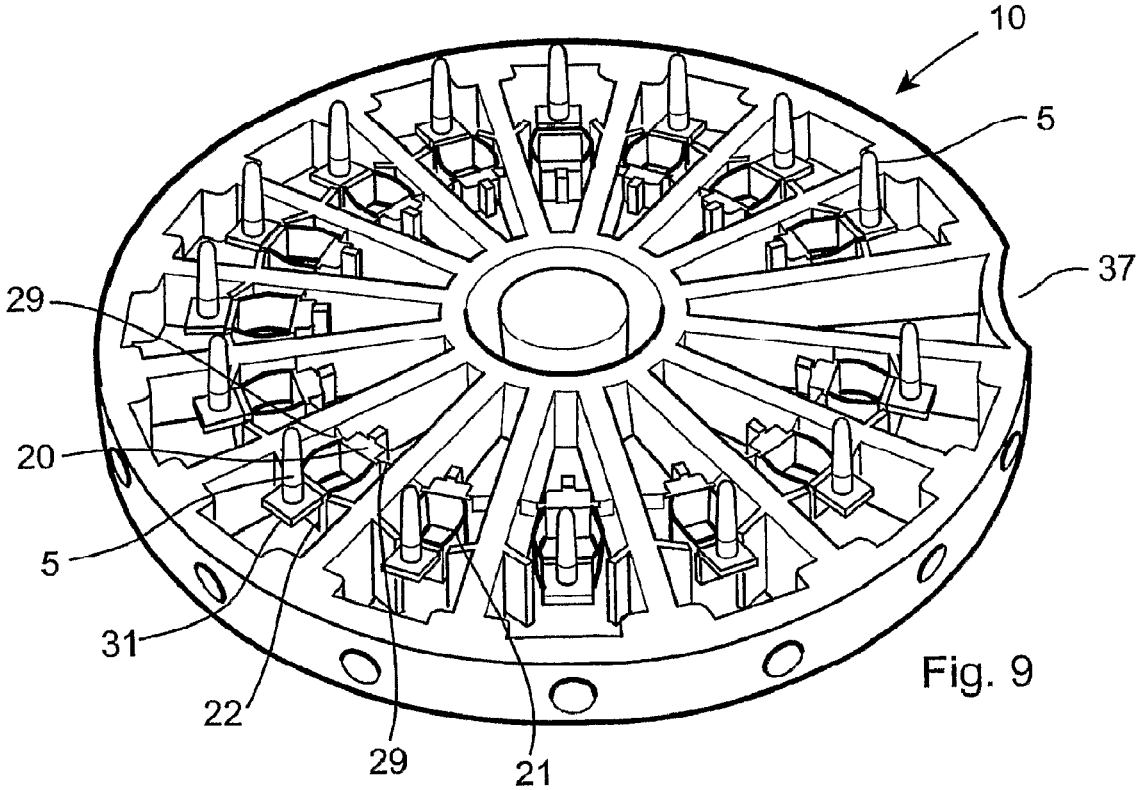
FIG. 9 is an isometric view of the wheel-shaped member of FIG. 3 shown in its initial moulded state.
Figure 10:
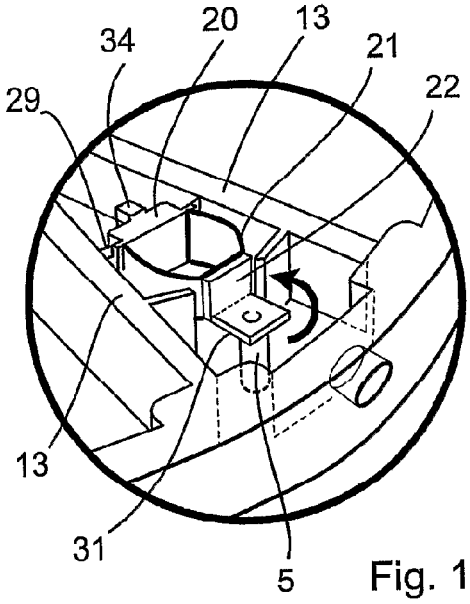
FIGS. 10 to 12 are isometric details of the wheel-shaped member showing steps in its manufacture.

When the device 1 is not in use, the compartment 11' which does not have an aperture in its outer peripheral wall 4, is aligned with the gap 9 in the shield wall 8 as illustrated in FIG. 7, so as to inhibit accidental actuation of any elongate stem 5. The outer peripheral wall of the compartment 11' has a curved indent 37 to highlight the device 1 being set to a position in which the stems 5 cannot be actuated. In manufacturing the device 1, the wheel-shaped member 10 is moulded as a unitary piece of plastics material integral with the elongate stepped stems 5, the stem base portions 22, the resilient bands 21 and the base portions 20. Referring to FIGS. 9 and 10, each base portion 20 is initially attached to the side walls 13 of the compartment 11 by a pair of frangible nubs 29. The stem base portion 22 has a hinged pivotal part 31 from which the stem 5 protrudes. The pivotal part 31 is initially pivoted so that the stem 5 extends downwardly (in FIG. 10) relative to the wheel-shaped member 10. This enables the stem 5 to be cast in one surrounding mould and not between two mould faces or halves which would cause a pair of seams to be formed along the length of the stem 5.

Figure 11:
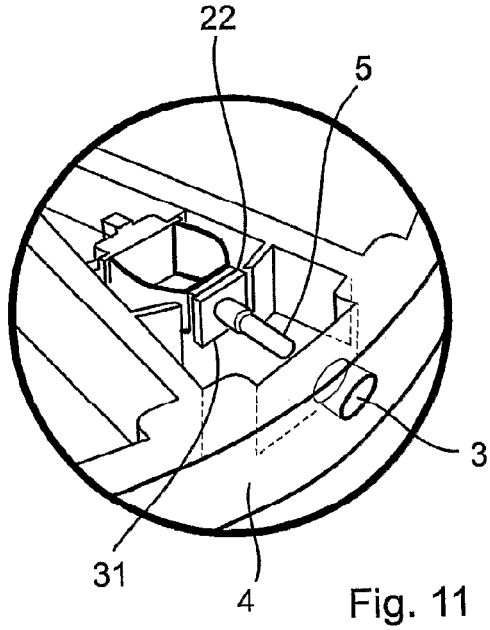
Figure 12:
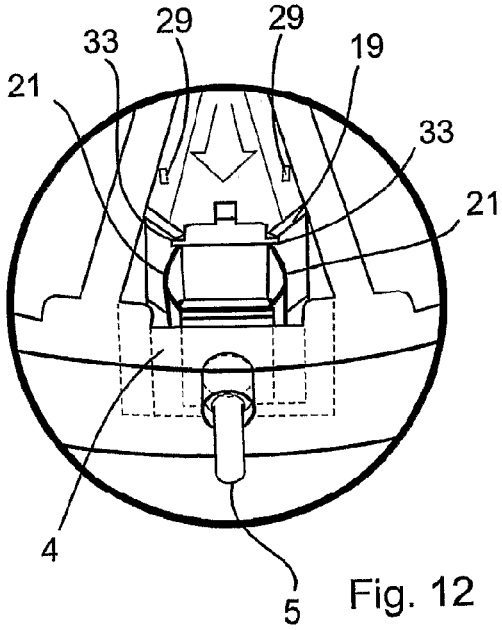

After the wheel-shaped member 10 has been moulded the elongate stem 5 is rotated about the hinge of the stem base portion 22 until the pivotal part 31 contacts a face of the part of the stem base portion 22 to which the pivotal part 31 is hinged and cannot rotate any further. This aligns the elongate stepped stem 5 with the aperture 3 in the outer peripheral wall 4 of the wheel-shaped member 10 (see FIG. 11). Pressure is applied to the back of the base portion 20 so as to break the base portion 20 from the nubs 29 and push the elongate stem 5 through the aperture 3 until the stem base portion 22 abuts the inner planar face 18 of the outer wall 4 of that compartment 11. The infills 32 can help guide the stem base portion 22 so that the stem 5 enters the aperture 3. The base portion 20 is also pushed past the side wall stop members 19 causing the base portion flanges 33 to deflect the stop members 19 inwardly until they regains their original shape once the flanges 33 have passed (see FIG. 12). Having the base portion 20 pushed past the stop members 19 causes the resilient bands 21 to be sufficiently compressed so that the stem base portion 22 is biased against the planar face 18 to form a seal and the flanges 33 abut against the stop members 19.

The second cover 16 is glued or heat sealed to one side of the wheel-shaped member 10 and each compartment 11 is filled with perfume. Compartment 11' which does not have an aperture 3 is left empty. The first cover 15 is glued or heat sealed to the opposite side of the wheel-shaped member 10 so that the perfume is sealed within the disc-shaped perfume holder 2. The attached covers 15, 16 are not glued or heat sealed to the resilient bands 21, the stem base portion 22 or stem 5 for each compartment 11 of the wheel-shaped member 10 so that the stems 5 can be actuated. The covers 15, 16 may, perhaps, be glued or heat sealed to the base portions 20 and/or to either end of the column portion 34. Each cover 15, 16 has a curved notch 38 (see FIG. 2) matching the curved indent 37 in the outer peripheral wall 4 so that the covers 15, 16 can be correctly aligned, the compartment identification numbers 35 printed on the first cover 15 matching the right compartments 11.

Figure 8:
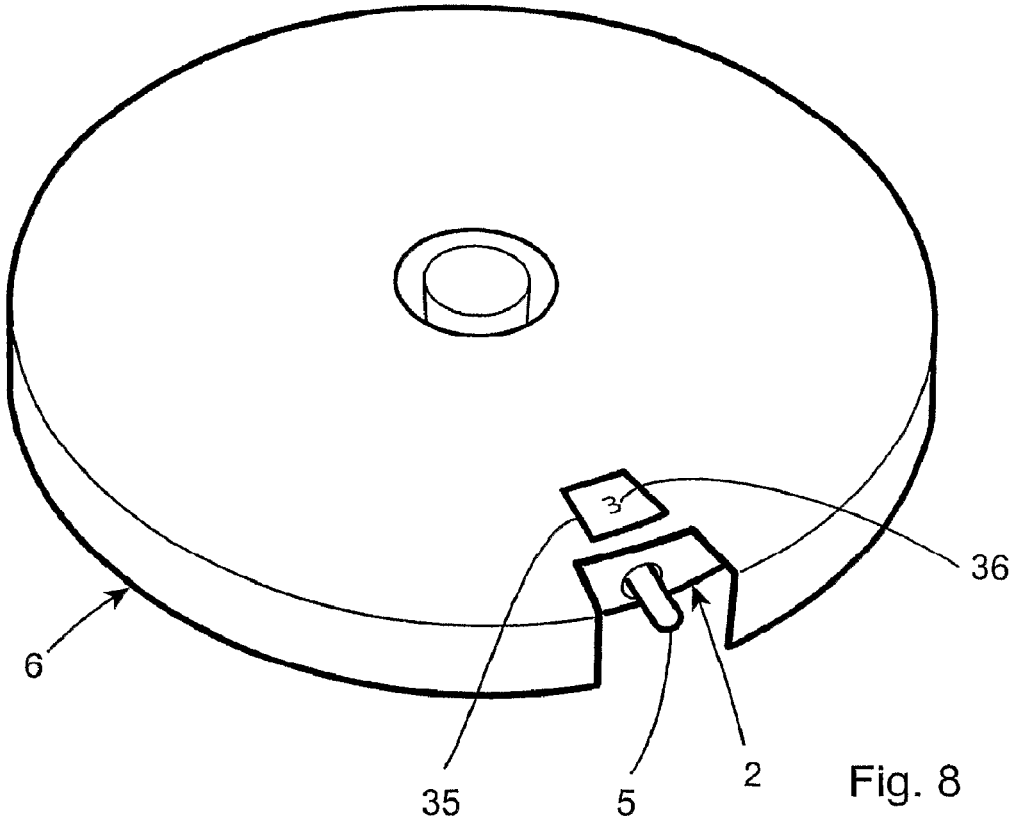
FIG. 8 is an isometric view of the device set for actuation.

The shield 6 is then attached to the holder 2 to form the device 1 as illustrated in FIGS. 1, 7 and 8.

Figure 14:
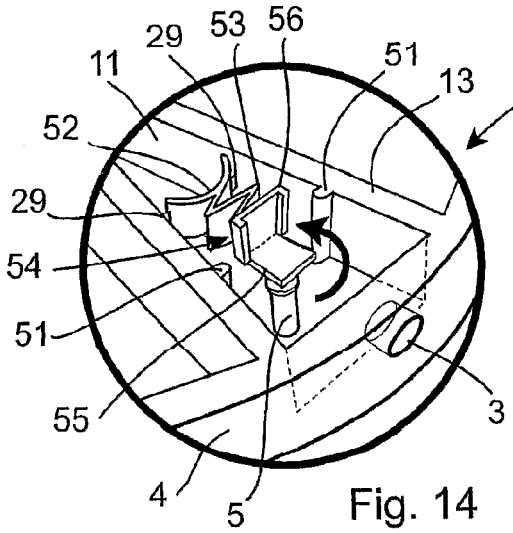
FIGS. 14 and 15 are schematic isometric details of the wheel-shaped member of a device in accordance with a second embodiment of the invention.
Figure 15:
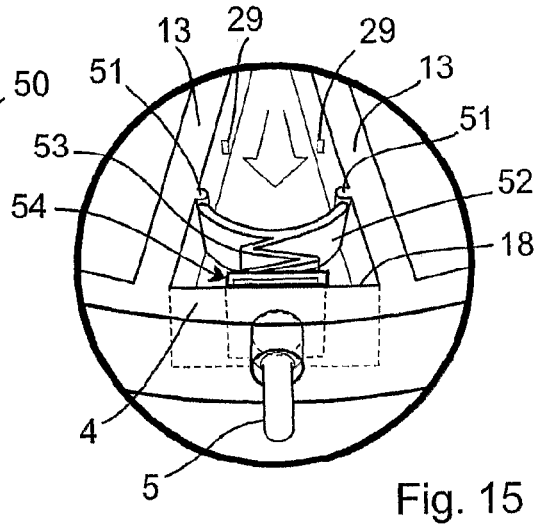

A second embodiment is illustrated in FIGS. 14 and 15 and parts of the device 50 which remain unchanged have the same reference numerals as used in describing the first embodiment.

Each stop member 51 extends from an opposite side wall 13 of a compartment 11. A curved portion 52 abuts against the stop members 51 and curves towards the outer peripheral wall 4. A resilient zig-zag portion 53 extends from the curved portion 52 to the stem base portion 54. The pivotal part 55 having the elongate stem 5 is hinged to a channel part 56 of the stem base portion 54 and is of a size to fit between the sides of the channel part 56.

In manufacturing the device 50, the elongate stem 5 is rotated about the hinge of the stem base portion 54 until the pivotal part 55 fits within the channel part 56 and cannot rotate any further. Pressure is applied to the back of the curved portion 52 so as to break the curved portion 52 from nubs 29 on the compartment side walls 13. The curved portion 52 is pushed past the side wall stop members 51 causing the ends of the curved portion 52 to be deflected inwardly until the curved portion 52 regains its original shape once past the stop members 51. Having the curved portion 52 pushed past the stop members 51 causes the resilient zig-zag portion 53 to be sufficiently compressed so that the stem base portion 54 is biased against the planar face 18 of the outer peripheral wall 4 of the compartment 11 to form a seal and the ends of the curved portion 52 abut against the stop members 51.

Figure 16:
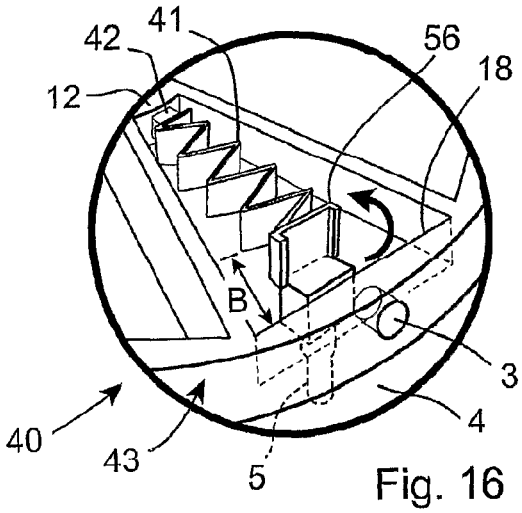
FIGS. 16 and 17 are schematic isometric details of the wheel-shaped member of a device in accordance with a third embodiment of the invention.
Figure 17:
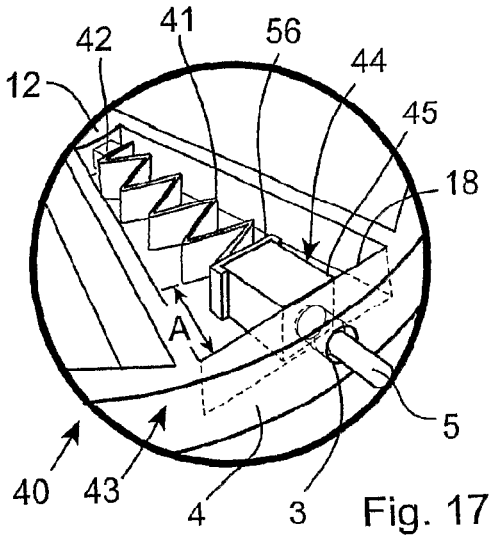

In a third embodiment illustrated in FIGS. 16 and 17, the resilient zig-zag portion and the stem base portion of the second embodiment have been modified. Parts of the device 40 which remain unchanged have the same reference numerals as used in describing the second embodiment.

The resilient zig-zag portion 41 extends from a protrusion 42 on the inner peripheral wall 12 of the wheel-shaped member 43 to the stem base portion 44 abutting the planar face 18 of the outer wall 4 (see FIG. 17) and no stop members or nubs are required. Also, the pivotal part 45 of the stem base portion 44 extends beyond the channel part 56 of the stem base portion 44.

In manufacturing the device 40, the wheel-shaped member 43 is moulded with the elongate stepped stem 5 pivoted downward relative to the wheel-shaped member 43 (see FIG. 16) and the resilient zig-zag portion 41 uncompressed (i.e. unbiased). The resilient zig-zag portion 41 is then sufficiently compressed to enable the elongate stem 5 to be rotated so that it is within the outer peripheral wall 4 and aligned with the aperture 3. Following this, the zig-zag portion 41 is released so that the pivotal part 45 of the stem base portion 44 abuts the planar face 18 and the elongate stepped stem 5 extends through the aperture 3 and forms an interference fit therewith.

The distance or spacing "A" (see FIG. 17) between the face of the pivotal part 45 which abuts the planar face 18 and the end of the channel part 56 adjoining the resilient zig-zag portion 41 is greater than the distance or spacing "B" (see FIG. 16) between the end of the resilient zig-zag portion 41, when unbiased, adjoining the channel part 56 and the planar face 18 to ensure that the pivotal part 45 is biased against the planar face 18 to form a seal in the finished device 40.

Whilst particular embodiments have been described, it will be understood that various modifications may be made without departing from the scope of the invention. For example, the resilient bands 21 or zig-zag portion 41 may be replaced by other forms of resilient means. The device 1 may not be restricted to a circular shape and may, for example, be rectangular where the shield slides along a rectangular perfume holder. The aperture 3 and/or stem 5 can be formed in any suitable way to form an interference fit such as having the aperture tapered to form a smaller aperture. Furthermore, any number of compartments may be provided, including a single compartment. In manufacturing the device 1, the pivotal part 31 may be initially connected by frangible nubs to the infills 32 of the compartment 4 and these nubs are broken when the elongate stem 5 is rotated.

What is claimed is:

1. A device for storing and dispensing liquids, said device comprising:

a liquid holder having first and second opposing walls joined together by at least one peripheral outer wall, said liquid holder having an interior comprising a plurality of separate sealed compartments, each said compartment comprising:

an aperture formed in the at least one peripheral outer wall of the compartment, sealing means for closing the aperture by direct sealing contact with the outer wall, resilient means mounted within said compartment and being arranged to bias the sealing means to close the aperture, and actuating means connected within said compartment to said sealing means and said resilient means and extending out of said compartment through said aperture, said actuating means being operable to move the sealing means away from the aperture to open said aperture against the bias of said resilient means, wherein the sealing means is at least provided by an interference fit between the actuating means and said aperture through which the actuating means extends, and said actuating means comprises an elongate member having at least two different cross-sectional areas along its length, a first cross-sectional area providing the interference fit to seal said aperture and a second cross-sectional area being smaller than said aperture, such that movement of said elongate member within said aperture releases said interference fit and opens said aperture.

2. The device as claimed in claim 1, wherein the sealing means comprises a seal formed with the compartment wall in which said aperture is formed.

3. The device as claimed in claim 2, wherein the actuating means comprises an elongate member extending through said aperture and on which the sealing means is mounted, such that actuation of said elongate member opens said aperture by moving said seal away from said compartment wall.

4. The device as claimed in claim 1, comprising a molded unitary piece of plastics material forming at least one wall comprising of each said compartment, the sealing means, the resilient means and the actuating means.

5. The device as claimed in claim 1 , wherein the compartments are arranged in an annular formation with each of said apertures being formed in an outer peripheral wall of said device.

6. The device as claimed in claim 1, including a movable shield provided over each aperture so as to inhibit accidental actuation of said actuating means.

7. The device as claimed in claim 3, further comprising a liquid stored in each of said compartments.

8. The device as claimed in claim 7, wherein a different liquid is stored in each of said compartments.

9. A device for storing and dispensing liquids, said device comprising:

a member having first and second opposing walls joined together by at least one peripheral outer circular wall, and containing a plurality of individually selectable separate sealed compartments each with an independent dispensing assembly;

each said individually selectable separate sealed compartment having an aperture extending through the peripheral outer circular wall of said member;

each said aperture being provided with a said dispensing assembly;

each said dispensing assembly being formed from a stem, a stem base portion, an inner base portion, and resilient means located between the inner base portion and the stem base portion, the inner base portion being held retained in position in said compartment, the stem of said dispensing assembly extending through said aperture, with said stem, stem base portion, or both, sealing said aperture by the biasing of said resilient means which biases said stem base portion providing direct sealing contact against said circular outer wall;

each said dispensing assembly being operable to open said aperture by pushing said stem against said biasing means, and to close said aperture upon releasing said stem by the biasing of said resilient means which biases said stem base portion against said circular outer wall such that said stem, stem base portion, or both, seals said aperture, wherein the stem has a larger diameter portion sealing said aperture by the biasing of said resilient means and said seal is provided by an interference fit between said stem larger diameter portion and said aperture.

10. The device as claimed in claim 9, including a movable shield provided over a plurality of said apertures so as to inhibit accidental depression of dispensing assemblies.

11. The device as claimed in claim 9, comprising a molded unitary piece of plastics material forming at least a portion of each compartment and the dispensing assemblies.

12. The device as claimed in claim 9 wherein said stem comprises an elongate member having at least two different cross-sectional areas along its length, a first cross-sectional area providing said interference fit to seal said aperture and a second cross-sectional area being smaller than said aperture, such that movement of said stem within said aperture releases said interference fit and opens said aperture.

13. The device as claimed in claim 9, further comprising a liquid stored in each of said compartments.

14. The device as claimed in claim 13, wherein a different liquid is stored in each of said compartments.

15. A device for storing and dispensing liquids, said device comprising:

a disc shaped member having a plurality of individually selectable separate sealed compartments each with an independent dispensing assembly;

said individually selectable separate sealed compartments being formed from a circular outer wall, a circular inner wall, and a plurality of side walls connected from said circular inner wall to said circular outer wall, and a top cover and a bottom cover mounted to said circular outer wall and said circular inner wall;

each said individually selectable separate sealed compartment having an aperture in said circular outer wall;

each said aperture being provided with a said dispensing assembly, each said dispensing assembly being formed from a stem, a stem base portion, an inner base portion, and resilient means located between the inner base portion and the stem base portion, the inner base portion being held retained in position in said compartment; the stem having a larger diameter portion and a smaller diameter portion; the smaller diameter portion of the stem of said dispensing assembly extending through said aperture, with said stem larger diameter portion or stem base portion or both sealing said aperture by the biasing of said resilient means which biases said stem larger diameter portion into interference fit in said aperture and said stem base portion against said circular outer wall;

each said dispensing assembly being operable to open said aperture by pushing said stem against said biasing means, and to close said aperture upon releasing said stem by the biasing of said resilient means which biases said stem base portion against said circular outer wall such that said stem, stem base portion, or both, seals said aperture.

16. The device as claimed in claim 15, comprising a molded unitary piece of plastics material forming at least one wall of each of said compartments and said dispensing assemblies.

17. The device as claimed in claim 16, including a movable shield provided over a plurality of said apertures so as to inhibit accidental depression of dispensing assemblies.

* * * * *